US008512212B2

(12) United States Patent
Ish, III

(10) Patent No.: US 8,512,212 B2
(45) Date of Patent: Aug. 20, 2013

(54) ADJUSTABLE PRESS ARM APPARATUS AND METHODS FOR EXERCISE MACHINES

(75) Inventor: A. Buell Ish, III, Redmond, WA (US)

(73) Assignee: Vectra Fitness, Inc., Redmond, WA (US)

( * ) Notice: Subject to any disclaimer, the term of this patent is extended or adjusted under 35 U.S.C. 154(b) by 1678 days.

(21) Appl. No.: 10/913,132

(22) Filed: Aug. 5, 2004

(65) Prior Publication Data

US 2006/0030460 A1 Feb. 9, 2006

(51) Int. Cl.
*A63B 21/06* (2006.01)
*A63B 21/062* (2006.01)

(52) U.S. Cl.
USPC ..... 482/100; 482/93; 482/908

(58) Field of Classification Search
USPC ..... 482/92–94, 98–103, 908
See application file for complete search history.

(56) References Cited

U.S. PATENT DOCUMENTS 4,728,101 A 3/1988 King
4,793,608 A 12/1988 Mahnke et al.
4,875,676 A 10/1989 Zimmer
5,263,915 A * 11/1993 Habing ..... 482/99
5,356,360 A 10/1994 Johns
5,417,634 A 5/1995 Habing
5,472,397 A 12/1995 Ammoscato et al.
5,549,533 A 8/1996 Olson et al.
5,597,375 A 1/1997 Simonson
5,672,143 A 9/1997 Ish, III
5,779,601 A 7/1998 Ish, III
5,823,921 A 10/1998 Dawson
5,951,444 A * 9/1999 Webber ..... 482/99
6,251,052 B1 * 6/2001 Simonson ..... 482/100
6,447,430 B1 9/2002 Webb et al.
6,508,748 B1 * 1/2003 Ish, III ..... 482/100
6,746,378 B2 6/2004 Morris et al.

* cited by examiner

*Primary Examiner* — Oren Ginsberg

(57) ABSTRACT

Adjustable press arm apparatus and methods are disclosed. In one embodiment, an exercise machine includes a load, a force-transferring assembly operatively coupled to the load, and a movable press arm operatively coupled to a press arm adjustment assembly that is selectively engageable with the force-transferring assembly. The press arm adjustment assembly includes a moveable swing member having an indexing portion, and an engagement device coupled to and moveable with the swing member, the engagement device being adapted to operatively engage the force-transferring assembly. A locking device is coupled to the press arm and moveable between first and second position to selectively coupled and uncouple the press arm from the load.

24 Claims, 7 Drawing Sheets

ADJUSTABLE PRESS ARM APPARATUS AND METHODS FOR EXERCISE MACHINES

FIELD OF THE INVENTION

This invention relates to adjustable press arm apparatus and methods for exercise machines.

BACKGROUND OF THE INVENTION

Weight training machines are highly popular with people interested in exercising to maintain their health and appearance. Conventional weight training machines typically include a weight stack that provides a variable load, and one or more exercise stations coupled to the weight stack that enable a person to exercise different portions of their body. One of the exercise stations is typically a press station that includes a press arm. At the press station, a user may apply force to the press arm to perform a variety of different exercises.

For example, FIG. 1 is an isometric view of an exercise machine 100 that includes a press station 102 in accordance with the prior art. The exercise machine 100 includes a press station 102 having a press arm 106 pivotally coupled to a first upright member 108 of a support frame 109. The press arm 106 includes a laterally-extending member 110 that is operatively coupled by a cable-and-pulley assembly (not shown) to a weight stack 105 partially enclosed within a shroud 112. The exercise machine 100 further includes a high pull station 114 and a butterfly station 116 that are also operatively coupled to the weight stack 105 by the cable-and-pulley assembly. Exercise machines of the type shown in FIG. 1 are described more fully, for example, in U.S. Pat. No. 5,779,601 issued to Ish, which patent is incorporated herein by reference.

The press station 102 of the exercise machine 100 of FIG. 1 has many components that are associated with the operability and adjustability of the press arm 106. For example, FIGS. 2 through 4 provide various elevational views of the press station 102 of FIG. 1. As best shown in FIG. 2, the press arm 106 is fixed to a bracket 25 extending laterally from a rigid connection to the laterally-extending member 110. The member 110 has a right stub shaft 26*a* journaled in the first upright member 108 and a left stub shaft 26*b* that may be journaled into a second upright member 118 (FIG. 1). An adjustment assembly 30 is coupled to the laterally-extending member 110 that includes a swing arm 32 and a curved adjustment plate 33 which are journaled on the left stub shaft 26*b* at opposite sides of the second upright member 118, and are cross-connected by a cross-member 34 which is spaced from the second upright member 118. A lever arm 36 projects from the center of the cross-member 34, and the adjustment plate 33, and has an elongated hub 33*d* journaled on the stub shaft 26*b*.

As shown in FIG. 3, a cam strip 35 is shaped to receive a cable 52 and is mounted on the free end of the lever arm 36. A stop rod 37 is fixed to the free end of the lever arm 36 and positioned to the left of the cam strip 35. The stop rod 37 extends rearwardly from the lever arm 36 toward the second upright member 118 and preferably has a bumper on its rear end for engagement with the second upright member 118 as a stop.

Referring to FIGS. 3 and 4, the adjustment plate 33 has an arcuate forward edge containing a series of teeth 33*a* and having stop ears 33*b*, 33*c* at its opposite ends. Complementing the adjustment plate is a swing plate 38 extending along side the adjustment plate laterally from a weld connection to the left end of the extension tube 26. At its outer end, the swing plate 38 is formed with a retaining hook 38*a* doubling back around the toothed edge portion of the adjustment plate. This hooked portion 38*a* has a pair of aligned radially-extending slots 39 receiving a latching finger 40 extending through the slots integrally from the outer end of a link 41 of round bar stock having its inner end bent to provide an integral pin 42 passing through a hole in a crank 43. The crank 43 projects through a side opening in the laterally-extending member 110 from a rocker shaft 44 extending along the inside of the laterally-extending member 110. The rocker shaft 44 has its ends passing through openings in a pair of inserts 46 which are welded to the inner ends of the stub shafts 26*a*, 26*b* and to the laterally-extending member 110.

Adjacent its right end the rocker shaft 44 has a second crank 46 extending through a respective side opening in the laterally-extending member 110 to pivotally connect via an intermediate link 48 with a generally U-shaped handle 50. The handle 50 is swing-mounted for up and down swinging movement by right and left trunnion portions 50*a*-50*b* passing through holes in laterally spaced side walls of the bracket 25. The handle continues rearwardly beyond the trunnion 50*b* as a lever 51. The lever 51 and the crank 56 have holes therethrough receiving bent end portions 48*a*, 48*b* on the link 48. A tension spring 49 is anchored at one end on an ear mounted on the bracket 25 and has its other end hooked over the link 48 adjacent the outer end portion 48*a* of the link so as to bias the handle 50 downwardly toward the bracket 25.

In operation, manually swinging the handle 50 upwardly causes the lever 51 to swing downwardly in opposition to the spring 49 and thereby pull on the link 48 such that the crank 46 responsively is swung downwardly. The resulting turning of the rocker shaft 44 in the clockwise direction when viewed from the right end, swings the crank 43 at the left end of the rocker shaft downwardly, and this motion pushes on the link 41 such that the latching finger 40 is moved outwardly to the outer end of the slots 39. In this outer position the latching finger 40 is radially outward of the teeth in the adjustment plate 33. The press arm unit 24 is then free to be swung upwardly or downwardly to the desired starting position resulting in swinging of the swing plate 38 and latching finger 40 relative to the adjustment plate 33. The stop ears 33*b*, 33*c* limit movement of the press arm 106 during adjustment of its starting position. The adjustment handle 50 is then released causing the latching finger 40 to retract into one of the slots 39 and mesh between the adjacent teeth 33*a* on the adjustment plate 33, thereby coupling the swing plate 38 and adjustment plate 33 together.

From the foregoing it is seen that upward swinging of the press arm 106 from the selected starting position in performing a press exercise results in forward and upward swinging of the cam strip 35 by connection of the press arm unit therewith via the laterally-extending member 110, swing plate 38, latching finger 40, adjustment plate 33, and lever arm 32. As shown in FIG. 3, such movement of the cam strip 35*a*, results in tensioning of a press cable 52 positioned in a keyhole slot at the outer end of a brace 35*a* for the cam strip 35*a* and having a ball stop 53 engaging the brace 35*a*. The press cable 52 is part of the cable-and-pulley assembly coupled to the weight stack 105. Hence, upward swinging of the press arm 106 is resisted by the selected load of weight plates in the weight stack 105.

Although desirable results have been achieved using prior art exercise machines of the type shown in FIGS. 1-4, there may be room for improvement. For example, in the above-described apparatus, the relatively large number of components in the press station 102 increases the cost of manufacture and assembly, and therefore the overall cost of the exercise machine. The number of components may also increase the maintenance associated with the exercise machine 100. Thus, novel apparatus and methods that mitigate these characteristics of prior art exercise machines would be useful.

SUMMARY OF THE INVENTION

The present invention is directed to adjustable press arm apparatus and methods for exercise machines. Embodiments of apparatus and methods in accordance with the present invention may advantageously provide the desired operability and adjustability of the press arm with a relatively simple, robust, and less expensive assembly in comparison with the prior art.

In one embodiment, an exercise machine includes a load, a force-transferring assembly operatively coupled to the load, and a movable press arm operatively coupled to a press arm adjustment assembly that is selectively engageable with the force-transferring assembly. The press arm adjustment assembly includes a moveable swing member having an indexing portion, and an engagement device coupled to and moveable with the swing member, the engagement device being adapted to operatively engage the force-transferring assembly. A locking device is coupled to the press arm and moveable between a first position and a second position. In the first position, the locking device is engaged with the indexing portion and the swing member is coupled to the press arm such that a force exerted on the press arm is transmitted through the force-transferring assembly to the load. In the second position, the locking device is disengaged from the indexing portion and the swing member is decoupled from the press arm, allowing the position of the press arm to be adjusted as desired.

BRIEF DESCRIPTION OF THE DRAWINGS

Preferred and alternative embodiments of the present invention are described in detail below with reference to the following drawings.

DETAILED DESCRIPTION

The present invention relates to press arm apparatus and methods for exercise machines. Many specific details of certain embodiments of the invention are set forth in the following description and in FIGS. 5-12 to provide a thorough understanding of such embodiments. One skilled in the art will understand, however, that the present invention may have additional embodiments, or that the present invention may be practiced without several of the details described in the following description.

In general, apparatus and methods in accordance with the present invention may advantageously provide a press arm having significantly fewer parts than prior art assemblies. Thus, the desired operability and adjustability of the press arm may be achieved using a relatively simple assembly that is easier and less expensive to manufacture, assemble, and maintain in comparison with prior art adjustable press arms.

Figure 1:
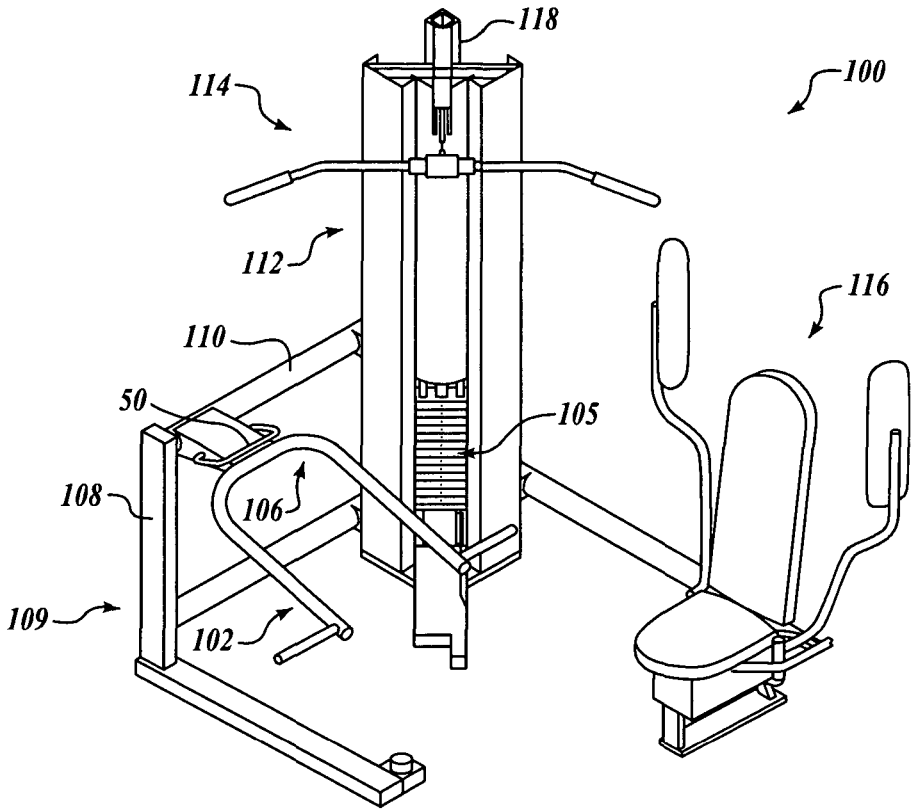
FIG.1 (PRIOR ART)
FIG. 1 is an isometric view of an exercise machine that includes a press station in accordance with the prior art.
Figure 2:
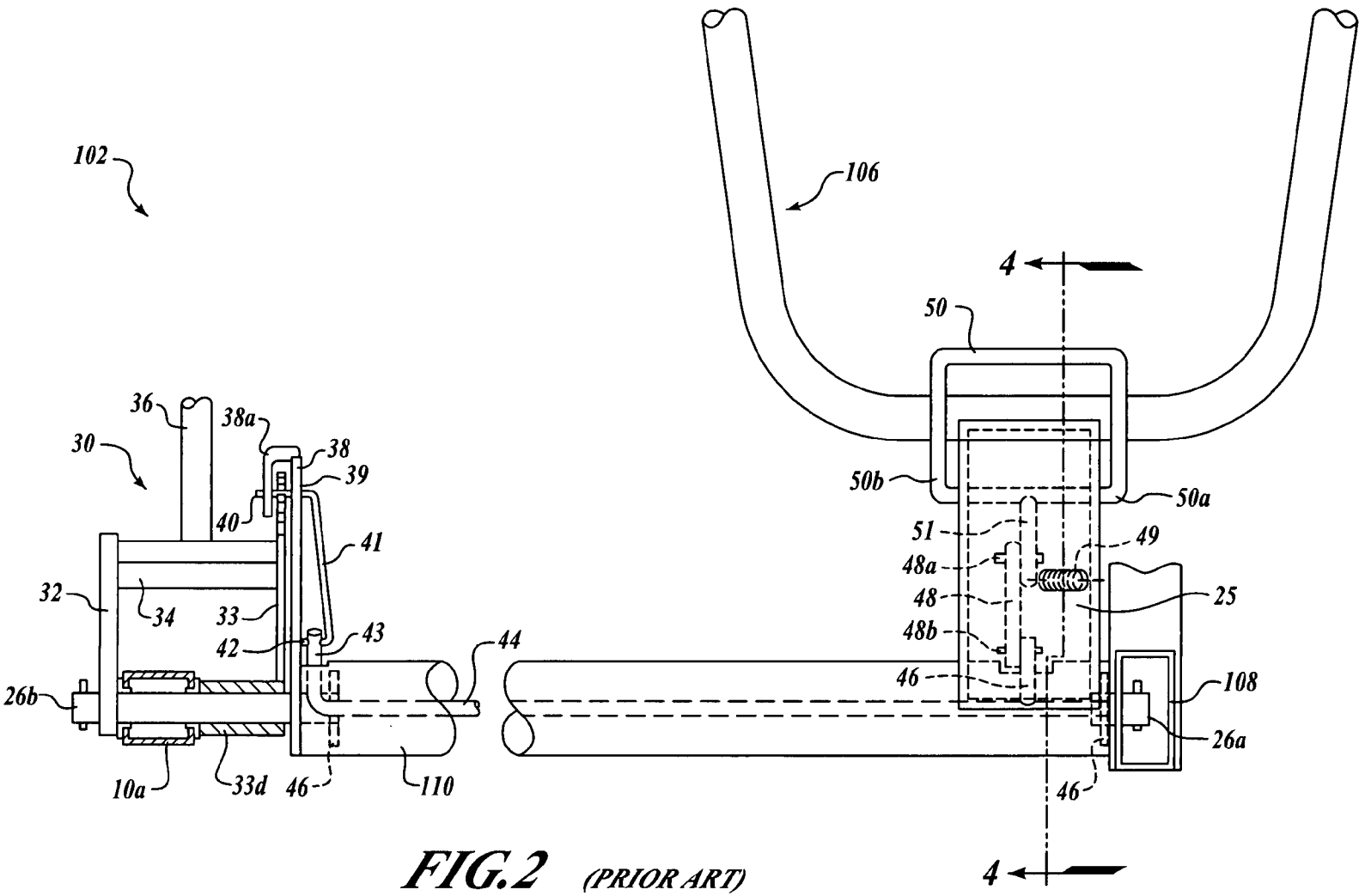
FIG. 2 (PRIOR ART)
FIG. 2 is an enlarged, partial elevational view of the press station of the exercise machine of FIG. 1.
Figure 3:
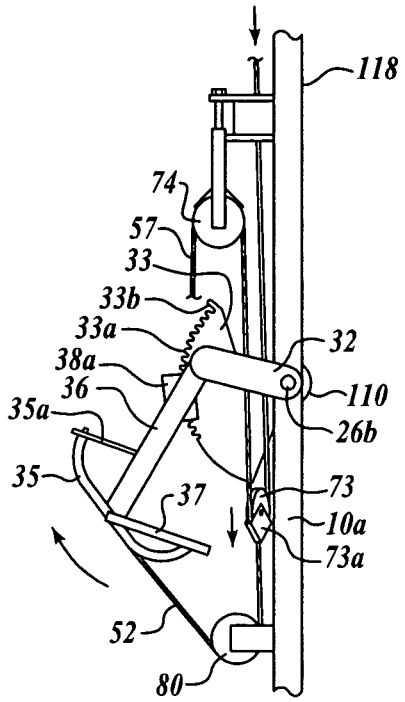
FIG.3 (PRIOR ART)
FIGS. 3 and 4 are partial side elevational views of the press station of FIG. 2.
Figure 4:
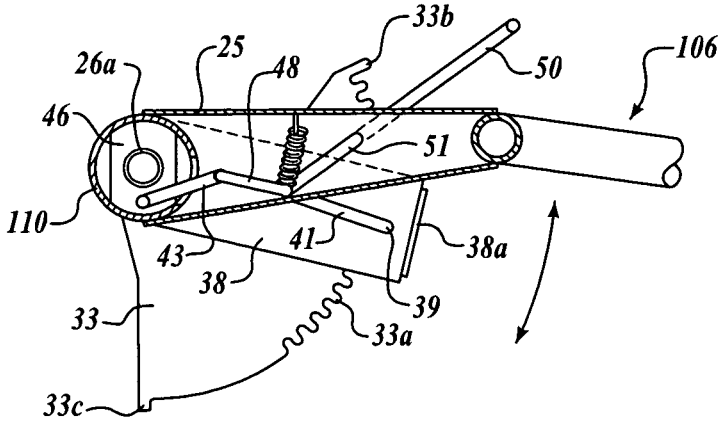
FIG.4 (PRIOR ART)
Figure 5:
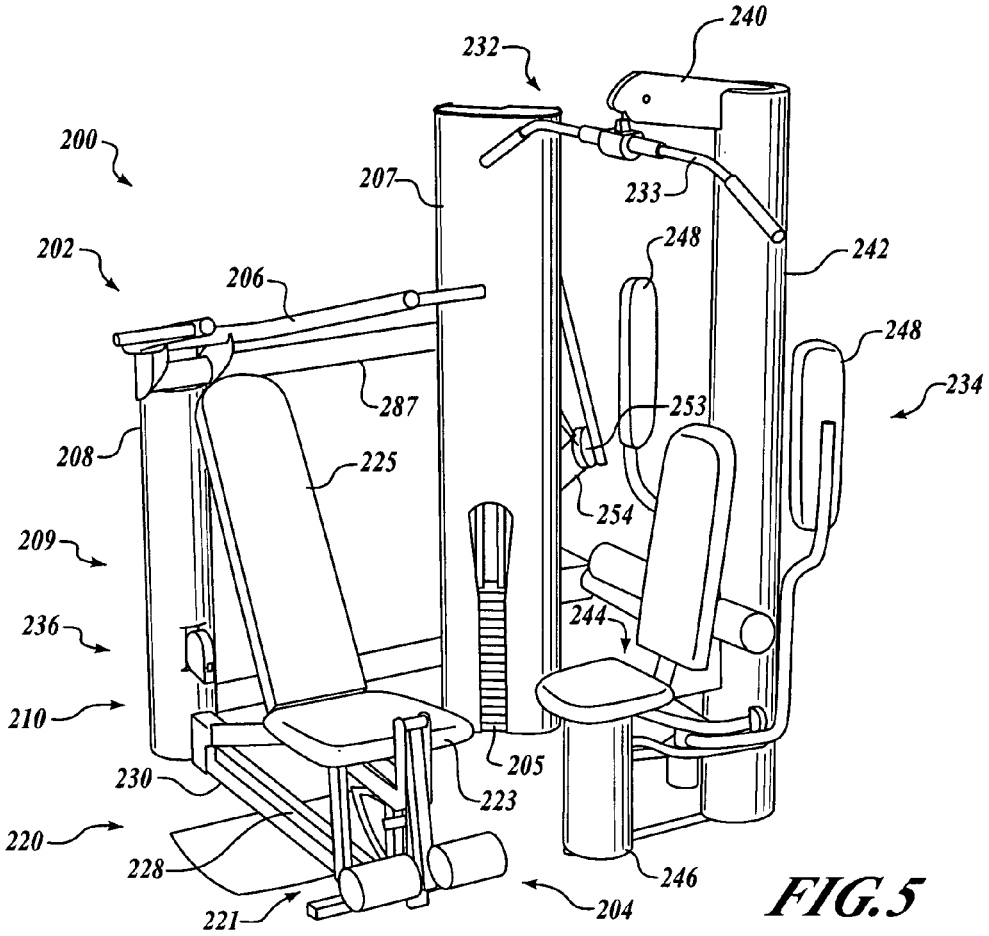
FIG. 5 is an isometric view of an exercise machine having a press station in accordance with an embodiment of the present invention.
Figure 6:
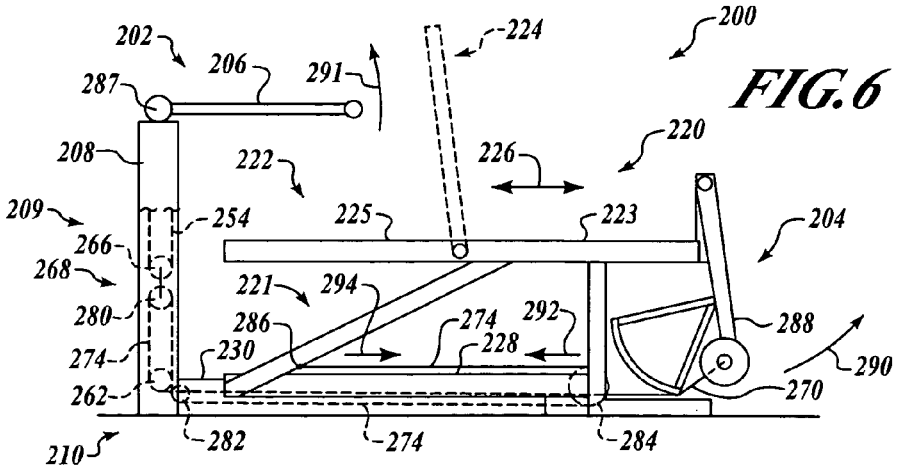
FIG. 6 is a side elevational view of the press station of the exercise machine of FIG. 5.

FIGS. 5 and 6 are isometric and side elevational views of an exercise machine 200 having a press station 202 in accordance with an embodiment of the present invention. In this embodiment, the press station 202 is positioned proximate a first end of an adjustable bench 220, and a leg station 204 is positioned at least proximate to (including possibly attached to) a second end of the adjustable bench 220. The press station 202 includes a press arm 206 pivotally coupled to a first upright member 208 of a support frame 209. The components of the press station 202 are described more fully below with reference to FIGS. 9 through 11.

As shown in FIG. 5, the exercise machine 200 further includes a lat pull (or high pulley) station 232, a butterfly station 234, and a low pulley station 236. The lat pull station 232 includes a lat bar 238 positioned at an end of a reach arm 240 that extends outwardly from an upper end of a second upright member 242. The butterfly station 234 includes a seat 244 positioned atop a third upright member 246 of the support frame 209, and a pair of moveable swing arms 248 operatively coupled to the support frame 209 and positioned proximate the seat 244. Thus, while seated on the seat 244, a user may perform exercises using the lat pull station 232 and the butterfly station 234. The low pulley station 236 is positioned near a lower end of the first upright member 208, and is typically used by standing proximate the first upright member 208. As described more fully below, a cable-and-pulley assembly 250 (FIG. 7) is coupled to the exercise stations 202, 204, 232, 234, 236, and operatively couples the exercise stations 202, 204, 232, 234, 236 to a weight stack 205 partially enclosed by a shroud 207 (FIG. 5).

Figure 7:
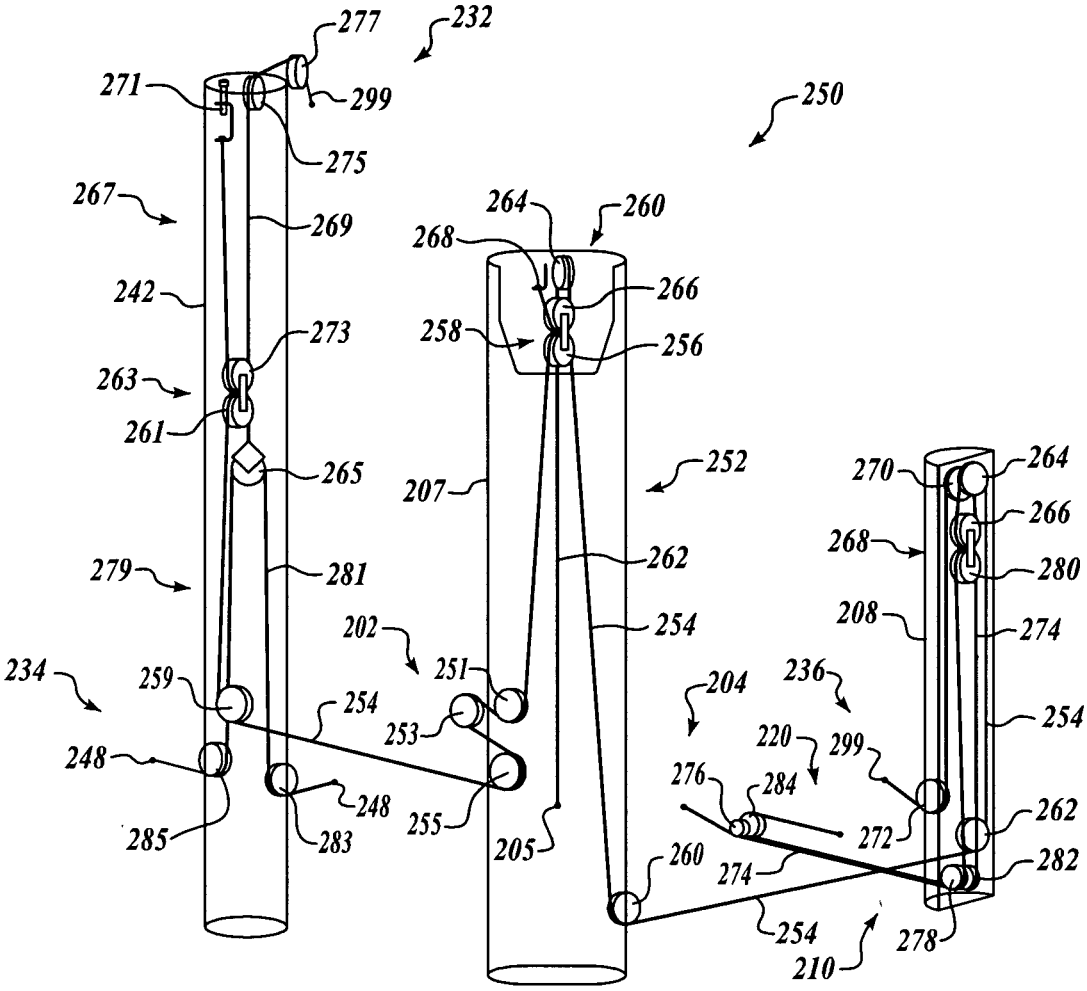
FIG. 7 is a schematic view of a cable-and-pulley assembly of the exercise machine of FIG. 5.

FIG. 7 is a schematic view of a cable-and-pulley assembly 250 of the exercise machine 200 of FIG. 5. In this embodiment, the cable-and-pulley assembly 250 includes a plurality of subassemblies that couple the various exercise stations to the weight stack 205. Except for certain inventive aspects of the cable-and-pulley assembly 250, the tensioning and cooperation of the one or more cable-and-pulley subassemblies is generally known and is described more fully, for example, in the above-referenced U.S. Pat. No. 5,779,601 issued to Ish, and in U.S. Pat. No. RE 34,572 issued to Johnson et al., which patent is incorporated herein by reference.

As shown in FIG. 7, in this embodiment, the cable-and-pulley assembly 250 includes a first cable-and-pulley subassembly 260 having a first cable 262 coupled to the weight stack 205 and extending upwardly through the shroud 207. The first cable 262 is engaged onto a first guide pulley 264 and an upper pulley 266 of a first double floating pulley 258. The first cable 262 terminates at a first anchor point 268 proximate an upper end of the shroud 207.

A second cable-and-pulley subassembly 252 includes a second cable 254 that is engaged onto a lower pulley 256 of the first double floating pulley 258 within the shroud 207. The second cable 254 is further engaged onto a second guide pulley 260 proximate a lower portion of the shroud 207, a third guide pulley 262 proximate a lower end of the first upright member 208, and a fourth guide pulley 264 proximate an upper end of the first upright member 208. The second cable 254 then engages onto an upper pulley 266 of a second double floating pulley 268, and onto fifth and sixth guide pulleys 270, 272 before terminating at the low pulley station 236. In this embodiment, a ball stop 299 is coupled to the second cable 254 proximate the low pulley station 236.

The second cable 254 also extends from the first double floating pulley 258 within the shroud 207 to seventh, eighth, and ninth pulleys 251, 253, 255 operatively associated with the press station 202. The second cable 254 then engages onto a tenth guide pulley 259 proximate a lower portion of the second upright member 242, and engages onto a lower pulley 261 of a third double floating pulley 263 before terminating at a single floating pulley 265.

Figure 8:
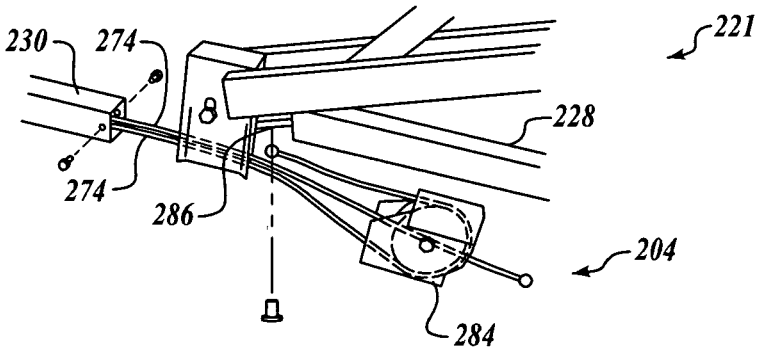
FIG. 8 is an enlarged, partially-exploded isometric view of a portion of the adjustable bench and the cable-and-pulley assembly of the exercise machine of FIG. 5.

As further shown in FIG. 7, a third cable-and-pulley subassembly 210 includes a third cable 274 having a first end coupled to the leg station 204. The third cable 274 is engaged onto eleventh and twelfth guide pulleys 276, 278, and extends upwardly through the first upright member 270 to engage onto a lower pulley 280 of the second double floating pulley 268. The third cable 274 further then engages onto a thirteenth guide pulley 282 and extends outwardly along the first horizontal member 230 of the support frame 209 (FIG. 6). As shown in FIGS. 6 through 8, the third cable 274 then engages onto a fourteenth guide pulley 284 that is coupled to the first horizontal support 230, and then extends back along the engagement member 228 to attach at a termination point 286 on the bench support assembly 221.

Referring again to FIG. 7, in this embodiment, a fourth cable-and-pulley subassembly 267 is operatively associated with the lat pull station 232. The fourth cable-and-pulley subassembly 267 has a fourth cable 269 coupled to a second anchor point 271 proximate an upper end of the second upright member 242. The fourth cable 269 engages onto an upper pulley 273 of the third double floating pulley 263, and onto fifteenth and sixteenth guide pulleys 275, 277 before terminating at the lat pull station 232. In this embodiment, a ball stop 299 is coupled to the fourth cable 269 proximate the lat pull station 232. As an exercising force is exerted on the lat bar 233 of the lat pull station 232, various portions of the cable-and-pulley assembly 250 are tensioned and cooperate such that a corresponding force is transmitted through the fourth cable 269, the second cable 254, and the first cable 262 to the weight stack 205.

Furthermore, a fifth cable-and-pulley subassembly 279 is associated with the butterfly station 234, and includes a fifth cable 281 engaged onto the single floating pulley 265. The fifth cable 281 is then engaged onto seventeenth and eighteenth guide pulleys 283, 285, and each end of the fifth cable 281 terminates at a swing arm 248 of the butterfly station 234. As an exercising force is exerted on one or both of the swing arms 248 of the butterfly station 234, various portions of the cable-and-pulley assembly 250 are tensioned and cooperate such that a corresponding force is transmitted through the fifth cable 281, the second cable 254, and the first cable 262 to the weight stack 205.

The operation of the press station 202 will now be described with reference to FIGS. 9 through 12. In this embodiment, the press arm 206 is coupled to a transfer member 287 that extends laterally from approximately the press station 202 to approximately the shroud 207. A press arm adjustment assembly 300 is coupled to the press arm 206 and includes a swing plate 302 coupled to the transfer member 287. The eighth pulley 253 of the second cable-and-pulley subassembly 252 is coupled to the swing plate 302.

Figure 10:
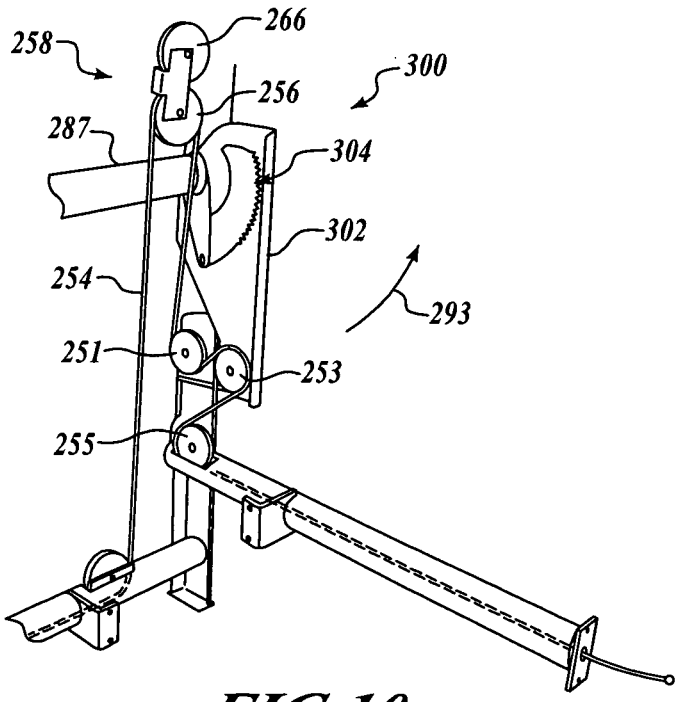
FIG. 10 is a partial isometric view of the press station of the exercise machine of FIG. 5.
Figure 11:
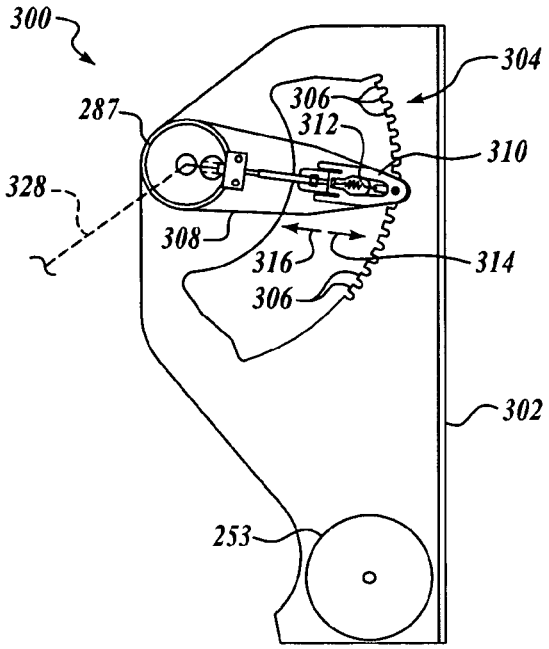
FIG. 11 is a side elevational view of an adjustment assembly of the press station of FIGS. 9 and 10.

As best shown in FIGS. 10 and 11, the press arm adjustment assembly 300 includes an indexing portion 304 formed in (or coupled to) the swing plate 302, and having a plurality of teeth 306. A bracket 308 is coupled to the transfer member 287 and rotates therewith. A locking member 310 is moveably coupled to the bracket 308, and a biasing spring 312 is engaged between the locking member 310 and the bracket 308. The biasing spring 312 exerts a biasing force on the locking member 310, urging the locking member 310 in a first (or locking) direction 314. The locking member 310 is also moveable in a second (or unlocking) direction 316.

Figure 12:
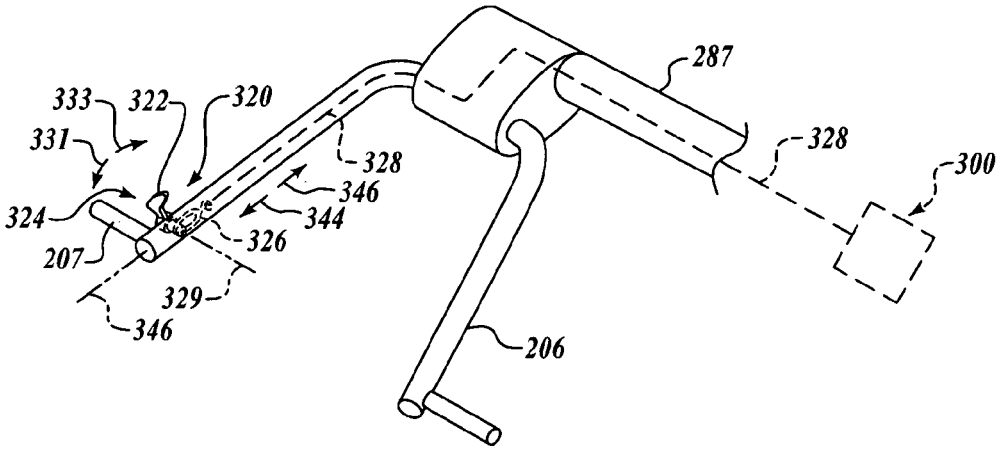
FIG. 12 is an isometric view of a portion of the press station of the exercise machine of FIG. 5.

As shown in FIG. 12, an actuator assembly 320 is positioned proximate a handle 207 of the press arm 206. The actuator assembly 320 includes a lever (or actuating handle) 322 attached to a shaft 324. The shaft 324 is rotatable about its axis 329 in forward and aft directions 331, 333. A coupling member 326 is engaged with the shaft 324, and an actuator cable 328 has a first end attached to the coupling member 326 and a second end attached to the locking member 310 of the press arm adjustment mechanism 300 (FIG. 11). Actuator assemblies of the type shown in FIG. 12 are described more fully, for example, in U.S. Pat. No. 6,508,748 B1 issued to Ish, incorporated herein by reference.

In operation, a user may move the lever 322 of the actuator assembly 320 in either a forward or aft direction 331, 333, causing the shaft 324 to rotate. In turn, the coupling member 326 is moved along a first axis 346 of the actuator cable 328. As the cable 328 is drawn in a tensioning direction 344, the locking member 310 is moved in the unlocking direction 316, releasing the bracket 308 from the indexing portion 304. The press arm 206 may then be freely rotated upwardly or downwardly so that the press arm 206 may be moved into a desired initial position. After the press arm 206 is moved into the desired position, the user may release the lever 322. The biasing spring 312 then urges the locking member 310 in the locking direction 314, re-engaging the bracket 308 with the indexing portion 304 and locking the press arm 206 in the desired position. The movement of the locking member 310 draws the actuating cable 328 and the coupling member 326 in a re-engagement direction 346, rotating the shaft 324 and returning the lever 322 to its initial position.

Figure 9:
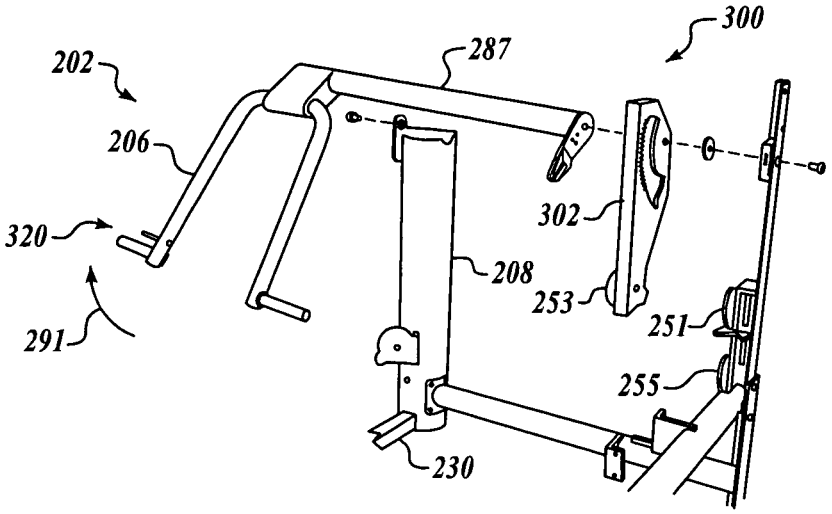
FIG. 9 is a partially-exploded isometric view of the press station of the exercise machine of FIG. 5.

The user may then exert a lifting force on the press arm 206 to cause the press arm 206 to rotate upwardly along an arc 291 (FIG. 9). In turn, the transfer member 287 is rotated and causes the swing plate 302, and thus the eighth pulley 253, to move along an arc 293 (FIG. 10). The seventh and ninth pulleys 251, 255 remain fixed in position relative to the eighth pulley 253 during the movement of the swing plate 302. Various portions of the cable-and-pulley assembly 250 are then tensioned and cooperate such that a corresponding force is transmitted through the second cable 254 and the first cable 262 to the weight stack 205 which provides the desired load for the exercise.

Press arm adjustment apparatus and methods in accordance with the present invention may provide substantial advantages over the prior art. For example, the desired operability and adjustability of the press arm may be achieved using a relatively simple assembly having significantly fewer parts than prior art assemblies. Thus, apparatus in accordance with the present invention may be easier and less expensive to manufacture, assemble, and maintain in comparison with prior art adjustable press arms.

In an alternate embodiment, the eighth pulley 253 that is coupled to the swing plate 302 may be eliminated, and the second cable 254 may be coupled directed to the swing plate 302. More specifically, after engaging onto the seventh pulley 251, the second cable 254 may terminate at the swing plate 302. Thus, when the user applies a training force on the press station 202, the movement of the swing plate 302 may pull directly on the second cable 254 to raise the training load.

Referring again to FIG. 6, in this embodiment, the adjustable bench 220 includes a bench support assembly 221 having a first portion 223 and a second portion 225 coupled thereto. An engagement member 228 of the support assembly 221 is adapted to slideably engage a first horizontal member 230 of the support frame 209. A user may pivot the second portion 225 into a first position 222 that supports the user in a prone position, or into a second position 224 that supports the user in a sitting position. If a user desires to move the adjustable bench 220 along a lengthwise axis 226 (FIG. 6), the user may simply push or pull the adjustable bench 220 in the desired direction until the desired position is achieved. The third cable 274 is operatively coupled between the leg station 204 and the termination point 286 on the bench support assembly 221 (FIG. 8) so that as the adjustable bench 220 is repositioned, the engagement member 228 slides over the first horizontal member 230 and the third cable 274 is simply drawn over the pulleys 276-284 of the third cable-and-pulley subassembly 210. Further aspects of the adjustable bench 220 are described more fully in co-pending, commonly owned U.S. patent application Ser. No. 10/913,137 filed concurrently herewith, which application is incorporated herein by reference.

In operation, as the user exerts a force on a swing arm 288 of the leg station 204 to cause the swing arm 288 to swing upwardly along an arc 290 (FIG. 6), one or more of the various cable-and-pulley subassemblies of the cable-and-pulley assembly 250 are tensioned and cooperate such that a corresponding force is transmitted through the third cable 254, the second cable 254, and the first cable 262 to the weight stack 205. The user's body may exert a first horizontal force 292 that tends to push the adjustable bench 220 toward the first upright member 208. Due to the configuration of the third cable-and-pulley subassembly 210 in combination with the other components of the exercise machine 200, however, the third cable 274 exerts a second horizontal force 294 on the bench support assembly 221 that tends to at least partially counteract the first horizontal force 292. Although the frictional forces between the engagement member 228 of the adjustable bench 220 and the first horizontal member 230 of the support frame 209 may be great enough to prevent the adjustable bench 130 from sliding on the first horizontal member 230 when the user is seated on the adjustable bench 130, the second horizontal force 294 tends to at least partially counteract the first horizontal force 292, thereby at least partially inhibiting or preventing the adjustable bench 220 from moving along the lengthwise axis 226 during the exercise.

Although the exercise machine 200 is described above and shown in the accompanying figures as having a weight stack 205, it will be appreciated that in alternate embodiments, a wide variety of devices may be used to provide the desired training load. For example, in alternate embodiments, the weight stack 205 may be replaced with a single weight, or with one or more hydraulic or pneumatic resistance devices, springs, stretchable bands, flexible rods, resilient members, bendable members, or any other suitable type of training load.

It will also be appreciated that, in alternate embodiments, it is not necessary that cable-and-pulley assemblies (and subassemblies) be used. A variety of known force-transmitting mechanisms may be used instead of cable-and-pulley assemblies, including, for example, belts, chains, levers, linkages, direct drives, hydraulic systems, and other suitable force-transmitting assemblies.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An exercise machine, comprising:

a load;

a force-transferring assembly operatively coupled to the load, wherein the force-transferring assembly includes a cable;

a movable press arm adjustably pivotable about a pivot axis; and a press arm adjustment assembly operatively coupled to the moveable press arm and selectively engageable with the force-transferring assembly, the press arm adjustment assembly including:

a moveable swing member having an indexing portion, the moveable swing member being rotatable with the moveable press arm about the pivot axis, the indexing portion including an arcuately-shaped surface having a plurality of engagement projections projecting outwardly from the arcuately-shaped surface along one or more projection directions;

an engagement device coupled to and moveable with the swing member, the engagement device being configured to operatively engage the force-transferring assembly, the engagement device being selectively disengageable from the moveable press arm and allowing the moveable press arm to move independently from the engagement device, wherein the engagement device is configured to fixedly attach the cable to the swing member; and a locking assembly configured to selectively disengage the press arm from the moveable swing member, including a locking device coupled to the press arm and moveable between a first position wherein the locking device is engaged with at least one of the plurality of engagement projections of the indexing portion and the swing member is coupled to the press arm such that a force exerted on the press arm is transmitted through the force-transferring assembly to the load, and a second position wherein the locking device is disengaged from the plurality of engagement projections of the indexing portion and the swing member is decoupled from the press arm such that a force exerted on the press arm is not transmitted through the force-transferring assembly to the load.

2. The exercise machine of claim 1, wherein the moveable press arm is operatively coupled to the moveable swing member by a laterally extending transfer member such that the swing member having an indexing portion is laterally displaced from a user.

3. The exercise machine of claim 1, wherein the force-transferring assembly comprises a cable-and-pulley assembly having at least one cable, and wherein the engagement device comprises a pulley adapted to engage the at least one cable.

4. The exercise machine of claim 1, wherein the cable comprises a first cable, and wherein the force-transferring assembly further includes a second cable coupled to the load and operatively coupled to the first cable, and wherein the engagement device comprises a pulley adapted to engage the first cable.

5. The exercise machine of claim 4, wherein the second cable is operatively coupled to the first cable by a double floating pulley.

6. The exercise machine of claim 1, wherein the press arm adjustment assembly further includes a biasing spring coupled to the locking member and adapted to bias the locking member into the first position.

7. The exercise machine of claim 1, further comprising an actuator assembly coupled to the press arm and having a control member operatively coupled to the locking member, the control member being moveable between an engagement position such that the locking member is in the first position, and a disengagement position such that the locking member is in the second position.

8. The exercise machine of claim 7, wherein the control member is coupled to the locking member by an actuator cable.

9. The exercise machine of claim 1, wherein the moveable swing member includes a substantially planar portion, the indexing portion being at least partially formed within the substantially planar portion such that the one or more projection directions are substantially directed toward the pivot axis, and wherein the locking device is moveable along a locking direction that is substantially aligned with the substantially planar portion.

10. The exercise machine of claim 1, further comprising a support operatively coupled to the load and stationary relative to the moveable swing member, and wherein the force-transferring assembly includes at least one pulley coupled to the support.

11. An exercise machine, comprising:

a load;

a cable-and-pulley assembly operatively coupled to the load;

a movable press arm adjustably pivotable about a pivot axis; and a press arm adjustment assembly operatively coupled to the moveable press arm and selectively engageable with the force-transferring assembly, the press arm adjustment assembly including:

a moveable swing member having an indexing portion that includes an arcuately-shaped surface having a plurality of engagement projections projecting outwardly therefrom, and an engagement portion configured to operatively engage a cable of the cable-and-pulley assembly, the moveable swing member being rotatable with the moveable press arm about the pivot axis, the engagement portion being selectively disengageable from the moveable press arm and allowing the moveable press arm to move independently from the engagement portion, wherein the cable is fixedly attached to the engagement portion of the swing member; and a locking assembly configured to selectively disengage the press arm from the moveable swing member, including a locking device coupled to the press arm and moveable between a first position wherein the locking device is engaged with at least one of the plurality of engagement projections of the indexing portion and the swing member is coupled to the press arm such that a force exerted on the press arm is transmitted through the cable-and-pulley assembly to the load, and a second position wherein the locking device is disengaged from the plurality of engagement projections of the indexing portion and the swing member is decoupled from the press arm such that a force exerted on the press arm is not transmitted through the cable-and-pulley assembly to the load.

12. The exercise machine of claim 11, wherein the moveable press arm is operatively coupled to the moveable swing member by a laterally extending transfer member such that the swing member having an indexing portion is laterally displaced from a user.

13. The exercise machine of claim 11, wherein the cable comprises a first cable and wherein the cable-and-pulley assembly includes a second cable coupled to the load and operatively coupled to the first cable.

14. The exercise machine of claim 11, wherein the moveable swing member includes a substantially planar portion, the indexing portion being at least partially formed within the substantially planar portion such that the one or more projection directions are substantially directed toward the pivot axis, and wherein the locking device is moveable along a locking direction that is substantially aligned with the substantially planar portion.

15. The exercise machine of claim 11, wherein the press arm adjustment assembly further includes a biasing spring coupled to the locking member and adapted to bias the locking member into the first position.

16. The exercise machine of claim 11, further comprising an actuator assembly coupled to the press arm and having a control member operatively coupled to the locking member, the control member being moveable between an engagement position such that the locking member is in the first position, and a disengagement position such that the locking member is in the second position.

17. The exercise machine of claim 16, wherein the control member is coupled to the locking member by an actuator cable.

18. The exercise machine of claim 11, further comprising a support operatively coupled to the load and stationary relative to the moveable swing member, and wherein the cable-and-pulley assembly further includes at least one stationary pulley coupled to the support proximate the swing member.

19. A method of exercising using an exercise machine, comprising:

approaching a press arm assembly operatively coupled by a force-transferring assembly to a load, wherein the force-transferring assembly includes a cable, the press arm assembly including a press arm coupled to an adjustment assembly, the press arm being pivotable about a pivot axis, the adjustment assembly including a swing member rotatable with the press arm about the pivot axis, the swing member having an indexing portion and an engagement portion configured to engage the force-transferring assembly, wherein the engagement portion is configured to fixedly attach the cable to the swing member, the indexing portion including an arcuately-shaped surface having a plurality of engagement projections projecting outwardly from the arcuately-shaped surface along one or more projection directions, the adjustment assembly being configured to selectively disengage the press arm from the swing member and the engagement portion;

actuating the adjustment assembly to disengage the press arm assembly from the swing member and the load, including disengaging at least part of the adjustment assembly from one or more of the plurality of engagement projections of the indexing portion;

adjusting a position of the press arm about the pivot axis;

actuating the adjustment assembly to engage the press arm assembly with the swing member and the load, including engaging at least part of the adjustment assembly with one or more of the plurality of engagement projections of the indexing portion; and exerting a force on the press arm to cause a moveable swing member of the adjustment assembly to rotate about the pivot axis and to cause an engagement portion of the swing member to engage with the force-transferring assembly, thereby transmitting the force to the load.

20. The method of claim 19, wherein actuating the adjustment assembly to engage the press arm assembly with the swing member and the load includes moving a locking device coupled to the press arm into engagement with at least one of the plurality of engagement projections of the indexing portion of the swing member to connect the press arm to the swing member such that the force exerted on the press arm is transmitted through the force-transferring assembly to the load.

21. The method of claim 19, wherein actuating the adjustment assembly to disengage the press arm assembly from the swing member and the load includes moving a locking device coupled to the press arm out of engagement with the indexing portion of the swing member to disconnect the press arm from the swing member such that the force exerted on the press arm is not transmitted through the force-transferring assembly to the load.

22. The method of claim 19, wherein:

actuating the adjustment assembly to disengage the press arm assembly from the swing member and the load includes moving a locking device coupled to the press arm out of engagement with the indexing portion of the swing member to disconnect the press arm from the swing member such that the force exerted on the press arm is not transmitted through the force-transferring assembly to the load;

adjusting a position of the press arm about the pivot axis includes moving the press arm to a desired position; and actuating the adjustment assembly to engage the press arm assembly with the swing member and the load includes moving the locking device coupled to the press arm into engagement with at least one of the plurality of engagement projections of the indexing portion of the swing member to connect the press arm to the swing member such that the force exerted on the press arm is transmitted through the force-transferring assembly to the load.

23. The method of claim 19, wherein exerting a force on the press arm to cause an engagement portion of the swing member to engage with the force-transferring assembly includes exerting a force on the press arm to cause a pulley coupled to and moveable with the swing member to engage with the force-transferring assembly.

24. The method of claim 19, wherein the moveable press arm is operatively coupled to the moveable swing member by a laterally extending transfer member such that the swing member having an indexing portion is laterally displaced from a user, and wherein exerting a force on the press arm to cause an engagement portion of the swing member to engage with the force-transferring assembly includes exerting a force on the press arm to cause an engagement portion of the swing member that is laterally displaced from the user to engage with the force-transferring assembly.

* * * * *